US006279174B1

(12) United States Patent
Candusso

(10) Patent No.: US 6,279,174 B1
(45) Date of Patent: Aug. 28, 2001

(54) FLUSHING, CLEANING DEVICE FOR SERVICE OF SANITARY FIXTURES

(76) Inventor: Aldo Candusso, Via Oppido Mamertina 1, 00178 Rome (IT)

( * ) Notice: Subject to any disclaimer, the term of this patent is extended or adjusted under 35 U.S.C. 154(b) by 0 days.

(21) Appl. No.: 09/275,454

(22) Filed: Mar. 24, 1999

Related U.S. Application Data

(63) Continuation-in-part of application No. 08/804,843, filed on Feb. 24, 1997, now abandoned, which is a continuation-in-part of application No. PCT/IT95/00140, filed on Aug. 21, 1995.

(30) Foreign Application Priority Data

Aug. 25, 1994 (IT) ..... RM94A0546

(51) Int. Cl.[7] ..... E03D 9/02
(52) U.S. Cl. ..... 4/224
(58) Field of Search ..... 4/431–433, 233, 4/222–224

(56) References Cited

U.S. PATENT DOCUMENTS

| | | | | |
|---|---|---|---|---|
| 4,183,105 | * | 1/1980 | Womack | 4/233 X |
| 4,581,779 | | 4/1986 | Matsui . | |
| 4,653,126 | | 3/1987 | Morandi et al. . | |
| 4,753,265 | | 6/1988 | Barrett . | |
| 5,007,117 | * | 4/1991 | Oldfelt et al. | 4/432 |
| 5,022,098 | * | 6/1991 | Brower | 4/233 |
| 5,123,124 | * | 6/1992 | Brower | 4/224 X |
| 5,295,274 | | 3/1994 | Daniels . | |
| 5,727,262 | * | 3/1998 | Littlejohn | 4/223 |
| 6,000,067 | * | 12/1999 | Cascia | 4/223 |

FOREIGN PATENT DOCUMENTS

| | | |
|---|---|---|
| 2826094 | 12/1979 | (DE) . |
| 0274588 | 7/1988 | (EP) . |
| 2603054 | 2/1988 | (FR) . |
| 2610815 | 8/1988 | (FR) . |
| 9319256 | 9/1993 | (WO) . |

* cited by examiner

*Primary Examiner*—Charles E. Phillips
(74) *Attorney, Agent, or Firm*—Stevens, Davis, Miller & Mosher, LLP

(57) ABSTRACT

A device for flushing, cleaning and servicing sanitary fixtures including an apparatus capable of heating and draining under control a pressurized fluid containing deterging, disinfecting, deodorizing substances and agents for dissolving calcareous deposits mixed with a suitable fluid which is conveyed to the sanitary fixture through pipes ending in spray nozzles which are placed around the upper edge of the sanitary fixture so as to direct the flush of the cleansing fluid to the inner surface thereof.

21 Claims, 3 Drawing Sheets

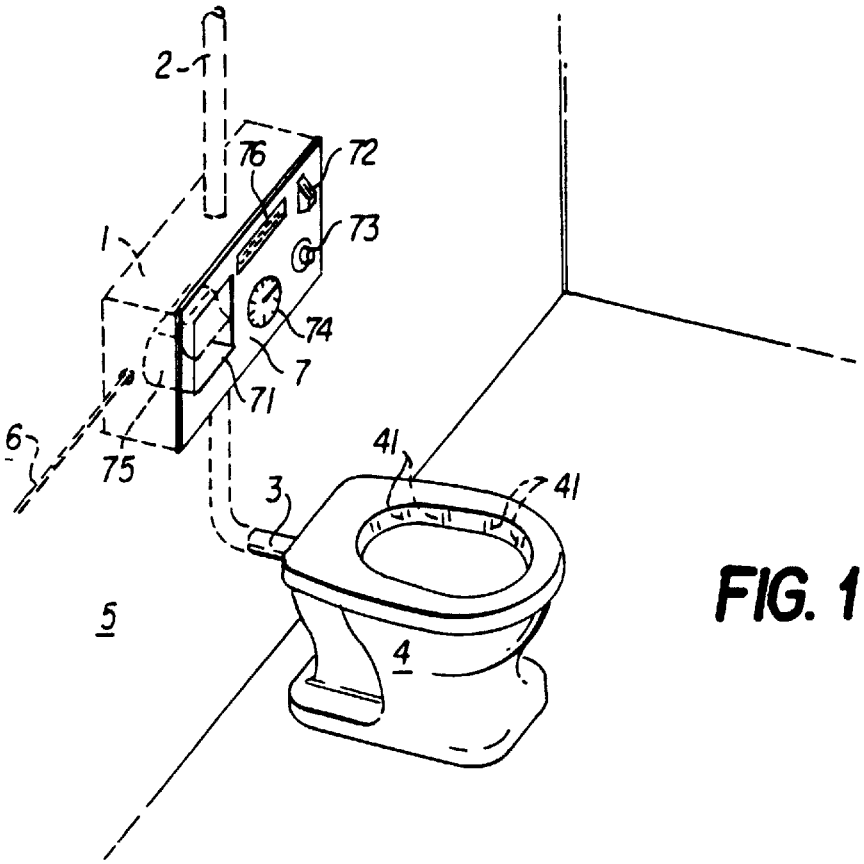
FIG. 1
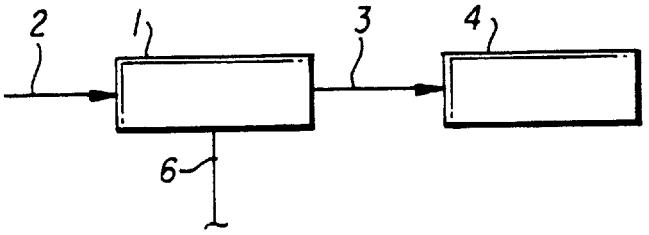
FIG. 1A
FIG. 2
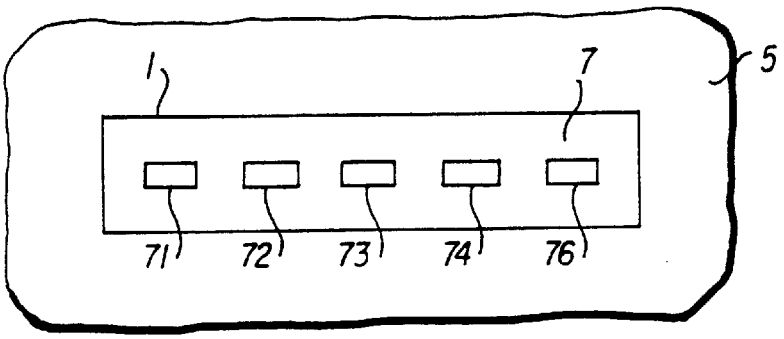

FLUSHING, CLEANING DEVICE FOR SERVICE OF SANITARY FIXTURES

CROSS REFERENCE TO RELATED APPLICATIONS

The present application is a continuation-in-part of U.S. patent application Ser. No. 08/804,843, filed Feb. 24, 1997, now abandoned, which is a continuation-in-part of Patent Cooperation Treaty international stage application Ser. No. PCT/IT95/00140, filed Aug. 21, 1995, now lapsed, both of which are incorporated herein by reference in their entirety.

FIELD OF THE INVENTION

The present invention relates to the field of the devices for flushing and cleaning sanitary fixtures, particularly the toilet bowl.

BACKGROUND OF THE INVENTION

As well-known to everybody a lot of different products or accessories such as brushes, sponges, sprayers and the like are employed at the present state of art for cleaning sanitary fixtures, Such a lot of accessories make the cleaning of the sanitary facilities particularly lengthy, tiresome and expensive because of the cost and the quantity of specific products to be used. In addition, it should also be appreciated that water shortage in particular environments or areas makes it necessary to wisely use the available resources. It is enough to think to the little water available in boats and trailers for holidays or, more seriously, in some geographic areas where water shortage is one of the most severe problems.

A further serious drawback directly influencing the hygiene of people is the difficulty and the insufficiency of some public bodies such as schools, colleges, camping, hospitals, where the sanitary facilities are often in a critical situation due to the high number of users, thus causing a risk for the health of the people.

DE-A-2826094 discloses an apparatus with a separated conduit for the cleaning fluid, suitable to be operated after the flushing operation.

FR-A-2603054 discloses an apparatus for the cleaning of the toilet bowl seat suitable to be fitted to all types of toilet bowls.

These solutions only partially solve the problems of the cleaning of the toilet bowls, and show a plurality of technical difficulties related to the installation of the additional devices that are not fully integrated with the toilet bowls' structure.

To solve such problems, in the hitherto installed sanitary facilities, particularly the toilet bowl, an additional supply of water is drained together with deodorizing soap, whereupon further cleaning and servicing interventions are needed such as the use of products for dissolving calcareous deposits in the pipes as well as cleansing agents and disinfectants along with their application means.

SUMMARY OF THE INVENTION

The present invention seeks to overcome such problems by providing a device which is easy to use and has little overall dimensions, which can be installed both in old and new facilities in order to allow the sanitary fixtures to be cleaned and deodorized in a little time with low consumption of water and cleansing agents and, at the same time, also operates as descaling and disinfectant agent for pipes.

The present invention is based on the inventive concept of providing a new electric appliance capable of doing without the usual flush tank and the auxiliary cleaning means such as the long-handled scrubbing brush as it is provided with means for heating and pressurizing water from a domestic water supply and for mixing the water flush under pressure with cleansing agents.

To this end, a device for cleaning and servicing sanitary fixtures according to the invention includes means for heating and draining under control into the sanitary fixture to be cleaned a pressurized flush of detergents, disinfectants, agents for dissolving calcareous deposits mixed with a suitable fluid which is supplied through pipes ending in spray nozzles placed along the edge of the sanitary fixture so as to flush the inner surface thereof until the draining pipe.

The advantages essentially consist in that such a device can allow the flow rate of the cleansing fluid to be varied according to the amount necessary to clean the sanitary fixture, thus saving water and cleansing agents. Moreover, the hitherto requested interventions to clean, deodorize and disinfect the sanitary fixtures and to prevent scales from being formed in the pipes are drastically curtailed. It should be further appreciated that such features are particularly important in the already mentioned public installation where the general use of the present invention easily and effectively solves the problem of the hygiene both of the sanitary facilities and the connected sewer line in which, if it is the case, appropriate rat disinfestation substances may be periodically poured.

Further advantages of the invention are the versatility and easiness of use, the noiselessness of operation, and the capability of being installed both in old and new facilities as it may be connected to the water pipe network or to a flush tank and be positioned above or below, outside or inside the masonry.

Finally, the device of the invention allows the desired admixture of the substances to be added to the main fluid and the suitable selection of those having the lowest environmental pollution available on the market.

BRIEF DESCRIPTION OF THE DRAWINGS

These and further advantages will be better understood by anyone skilled in the art from the following description with reference to the annexed drawings, in which like elements are labeled by like reference numerals, given as not limiting examples and in which:

FIG. 1 shows schematically a first embodiment of a device for cleaning sanitary fixtures according to the invention.

FIG. 1A also shows schematically the embodiment of FIG. 1.

FIG. 2 shows a schematic diagram of a control panel of a water flush box of the embodiment of FIG. 1.

DETAILED DESCRIPTION OF THE PREFERRED EMBODIMENTS

In a preferred embodiment of the invention, the construction of a device for flushing and cleaning domestic sanitary fixtures can be combined with the waterworks and the electric system generally existing in the buildings. More particularly, with reference to FIG. 1, such a conceived device consists of a water flush box 1 which is provided with an electromotor pump 76A (FIG. 3) for pressurizing the water and heating elements 75A (also known as electric resistances) for heating the water, housed in the wall 5, connected to water inlet pipe 2, and supplied by wires 6 connected to the electric system. Any pump having a suitable size to fit in the flush box 1 and capacity to pump the desired flush may be employed. A typical pump is HPV 2800 RPM, HPV 1750 RPM or IDM 1450 RPM pumps available from Annovi e Reverberi S.p.A., Italy.

The heating elements 75A are conventional resistance heaters. However, all kinds of heaters are suitable for heating the water. For example, the heating elements 75A may directly contact the water or indirectly contact the water. Moreover, the water feeding the flush box 1 through inlet pipe 2 may be from a cold water supply of the building plumbing system or a hot water supply of the building plumbing system.

Figure 3:
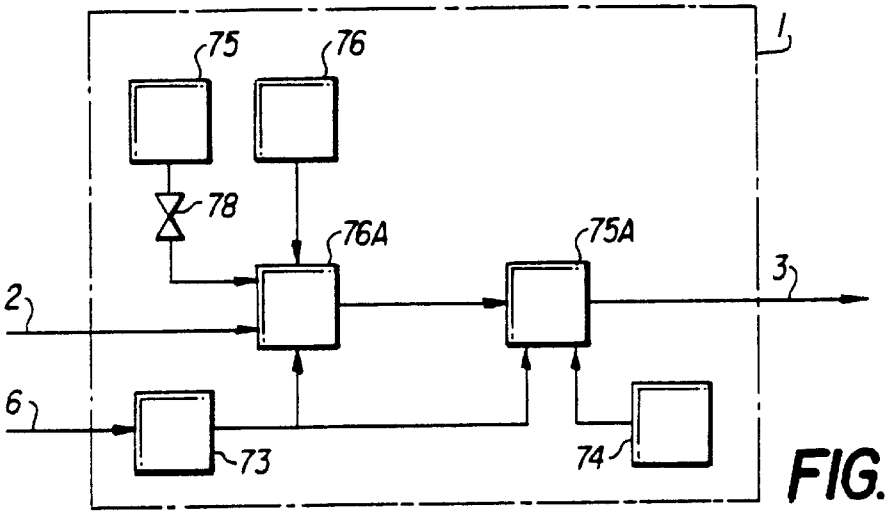
FIG. 3 shows a schematic diagram of elements within the water flush box of the embodiment of FIG. 1.

The front side of the water flush box 1 is provided with a control panel 7 (FIGS. 1, 2) including: a door 71 of an inner tank 75 containing the substances to be added to the water; a pilot light 72; an operation push button 73; a setting thermostat 74 (FIG. 3) which controls electric power to the electric resistances 75A; an air intake 76 for the electromotor pump 76A (FIG. 3). Air intake 76 feeds air directly to the electromotor pump 76A or merely to inside the flush box 1 to avoid overheating. The electromotor pump 76A may include a cooling fan. Provided at the output of the water flush box 1 is a conduit 3 which is connected at the other end to the gasket type union of a toilet bowl 4 connected in turn to nozzles 41 placed around the whole upper edge 16 of the base 14 of the bowl 4 and directed to the inner surface thereof.

FIG. 1 shows a particular example of a flush box 1 where the shape of the controls is shown. However, as apparent from FIG. 2, the controls on the front of the flush box I are not restricted to a specific shape.

In operation, the water flush box 1 receives water from inlet pipe 2 and heats it by means of electric resistances 75A controlled by thermostat 74. At the same time, the desired cleansing fluid is obtained by taking from tank 75 the deodorizing, deterging, disinfecting substances and the agent for dissolving the calcareous deposits. As seen in FIG. 3 water passes through inlet pipe 2 into the flush box 1 where it enters the electromotor pump 76A together with the deodorizing, deterging, disinfecting substances and the agent for dissolving the calcareous deposits from tank 75. The water and agents are mixed together either in the electromotor pump 76A or, in a modification not shown, just upstream of electromotor pump 76A to form a mixture of fluids in the form of an emulsion. The water and agents are pressurized by the electromotor pump 76A. The pressurized emulsion is discharged from the electromotor pump 76A and feeds the heater 75A which heats the emulsion. The electromotor pump 76A and electric resistances are powered by electricity from the wires 6. Typically, the electricity is controlled by the push button 73. Push button 73 may be a simple on/off switch, or be provided with a microprocessor (not shown) programmed to control electricity to electromotor pump 76A or electric resistance heater 75A or both.

A control valve 78 (FIG. 3) controls the flow of the cleaning (or other) agent into the water. A typical control valve 78 is a "venturi tube" that functions as an inlet pump that drains the cleaning (or other) agent into the water flow. However, the invention is not limited to a venturi tube valve. Other kinds of valves, such as an electromagnetically (for example opened by a solenoid) or electronically actuated valve may be employed. Such a control valve may be controlled by an electromagnetic or electronic circuit, but it need not be electromagnetically or electronically controlled.

To sum up, unlike what is known, the device of the present invention allows the deodorizing liquid and the deterging liquid to be added only when the water is pressurized, thus avoiding a tank for water emulsion mixture of such liquids. This is very important in view of the overall dimension and the water consumption. In addition, it is well known that the cleaning action of the emulsions decreases with time.

In use, the user pushes the operation button 73 and holds it until the desired degree of cleanliness of the sanitary fixture (toilet bowl) is reached. If desired, a conventional toilet bowl may be employed, but preferably a toilet bowl such as bowl 4 (FIGS. 1, 4) is employed.

Advantageously, only a few seconds are needed to clean the bowl 4 because of the simultaneous action of detergents, heat, and intensity of flushing. Further, the design of the inner walls of the bowl 4 and the arrangement of the nozzles 41 are combined so as to direct the flush without dispersions of liquid, thus optimizing cleansing efficiency. The nozzles 41 may be of metal or plastic. The nozzles 41 may even be simply holes in the ceramic of the upper rim 16 of the base 14 of the toilet bowl 4.

Figure 4:
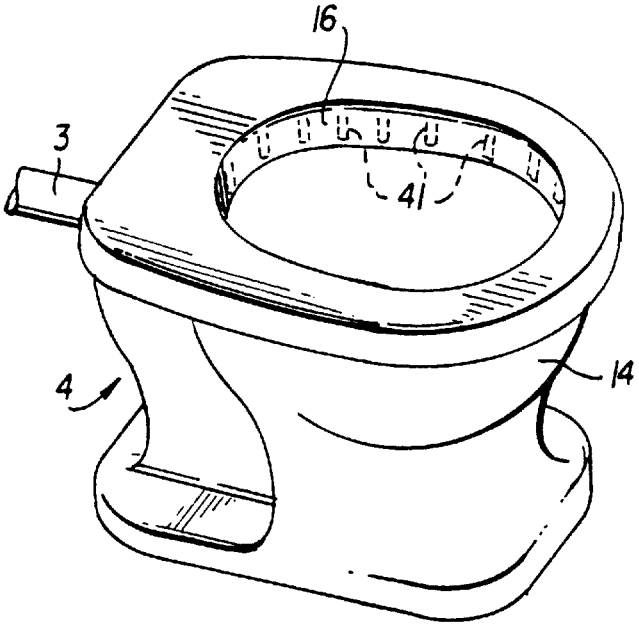
FIG. 4 shows a toilet bowl of the embodiment of FIG. 1.

In fact, as can be seen from FIGS. 1 and 4, the direction of holes (nozzles) 41 is illustrated with broken lines and is tangential to the inner surface of the toilet bowl 4, i.e., designed to skim the surface, so as to provide a strong cleaning action in combination with the pressure and the speed of the cleansing agent. The holes 41 are spaced apart any suitable distance.

Figure 4B:
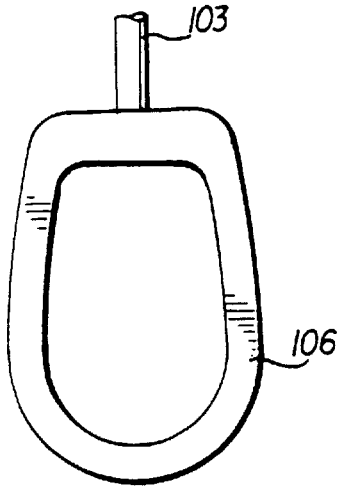
FIG. 4B shows a top view of the seat of the toilet bowl of FIG. 4A.
Figure 4A:
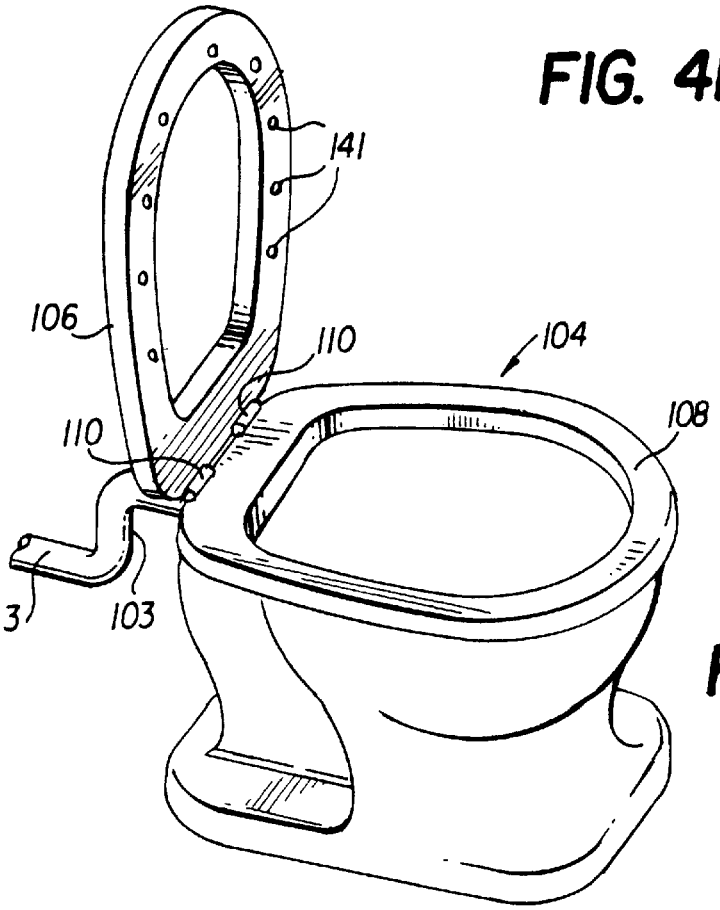
FIG. 4A shows a modification of the toilet bowl of the embodiment of FIG. 1.

In a variation of this embodiment, nozzles 141 may be provided on a seat 106 of a toilet bowl 104A (FIG. 4A). The seat 106 is held to the bowl 104 by hinges 110. The nozzles 141 are located to contact the inner walls of the bowl 104 without contacting an upper edge 108 of the bowl 104. A flexible end 103 of discharge pipe 3 is directly attached to the rear of the seat 106, as shown in FIG. 4B, to be in fluid communication with the nozzles 141. The nozzles 141 may be of metal or plastic fitted to the seat 106. In the alternative, the nozzles 141 may be integrally formed in the material of the seat 106.

Advantageously, in comparison with the water flushes on the market and their necessary adaptations, the device according to the invention may be installed in a very restricted room of the order of a couple of 20×20 cm tiles, and may require a maximum electrical input of about 2 kW which involves a negligible consumption due to the limited operation time.

Figure 5:
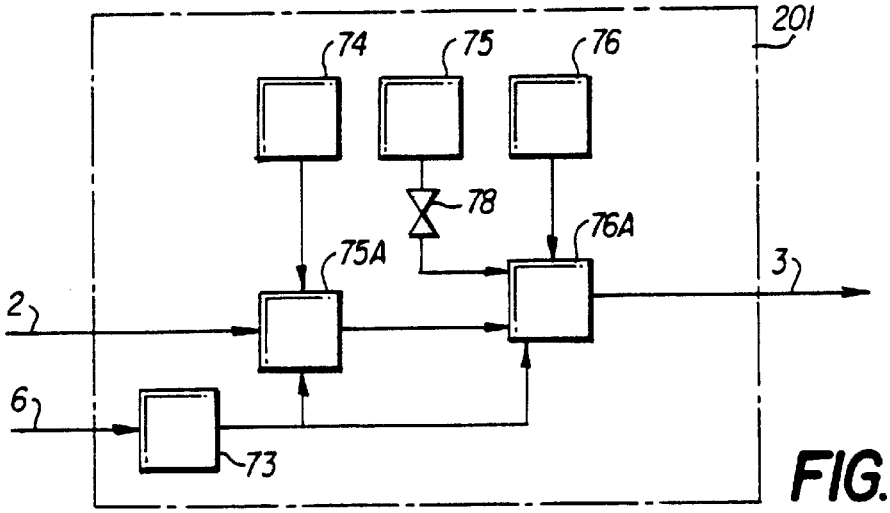
FIG. 5 shows schematically a second embodiment of a device for cleaning sanitary fixtures according to the invention.

FIG. 5 shows a second embodiment of the present invention which has a flush box 201 which operates as does the first embodiment but reverses the order of heating and pressurizing. Thus, only the water is heated by the heating element 75A.

Figure 6:
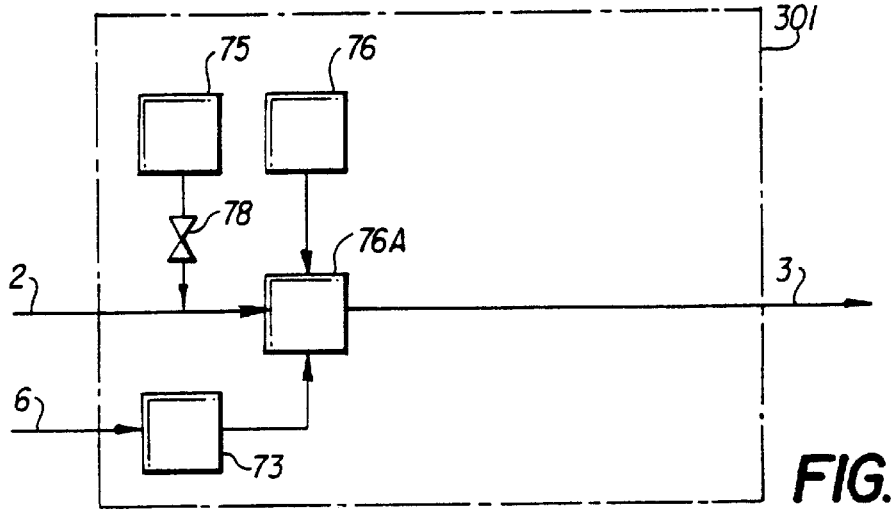
FIG. 6 shows schematically a third embodiment of a device for cleaning sanitary fixtures according to the invention which omits heating elements.

FIG. 6 shows a third embodiment of the present invention which has a flush box 301 which operates as does the first embodiment but omits heating elements. The third embodiment either uses cold water and has inlet pipe 2 connected to the cold water supply (not shown) of the building's plumbing system or, if hot water is desired, has inlet pipe 2 connected to the hot water supply (not shown) of the building's plumbing system. FIG. 6 also shows feeding the cleaning (or other) agent from the tank 75 into the inlet conduit 2 slightly upstream of the electromotor pump 76A.

As can be seen from the above-described exemplified embodiments, the pressure of the cleansing agent flowing from the flush box cannot be adjusted directly by the user, even if this could be made by controlling the flush box itself. However, it is preferred to disclose the easiest device which can be used where a number of different pressures for different cleaning steps can be programmed according to as long time as button 73 is pressed by the user.

The detail of the above-described exemplified embodiments may be varied in the form, dimension, nature and arrangement of the components without parting from the scope of the inventive spirit and then remaining within the limits of protection of the present industrial invention.

What is claimed is:

1. A device for flushing, cleaning and servicing a toilet bowl, comprising, an electrically operated water flush box, the flush box having an inlet for being connected to a water inlet pipe of a domestic water system and an outlet for connecting to a discharge pipe for being connected to the toilet bowl, the flush box comprising an electromotor pump for regulating the outlet pressure of water to be discharged from the flush box, an inner tank for containing at least one cleaning and deodorizing substance located within the flush box and means for admixing cleaning and deodorizing substances from the inner tank to the water in the flush box only when the water in the flush box is under pressure, thereby supplying under control for an adjustable time a flush of water, mixed with at least one substance selected from the group consisting of substances for deterging, disinfecting, and removing calcareous deposits from the toilet bowl to which the fluid is conveyed by the discharge pipe, comprising a push button for controlling the flow rate of the cleansing fluid to be varied according to the amount necessary to clean the toilet bowl.

2. A device for flushing, cleaning and servicing a toilet bowl, comprising, an electrically operated water flush box, the flush box having an inlet for being connected to a water inlet pipe of a domestic water system and an outlet for connecting to a discharge pipe for being connected to the toilet bowl, the flush box comprising an electromotor pump for regulating the outlet pressure of water to be discharged from the flush box, electrical resistance heaters for heating the water in the flush box, an inner tank for containing at least one cleaning and deodorizing substance located within the flush box and means for admixing cleaning and deodorizing substances from the inner tank to the water in the flush box only when the water in the flush box is under pressure, thereby heating and supplying under control for an adjustable time a flush of water, mixed with at least one substance selected from the group consisting of substances for deterging, disinfecting, and removing calcareous deposits from the toilet bowl to which the fluid is conserved by the discharge pipe, wherein the water flush box is provided with a control panel including: a door for supplying the substances to be added to the fluid, a thermostat for regulating the temperature of the fluid, a pilot light, and an operation push button.

3. The device according to claim 2, wherein the toilet bowl is provided with spray nozzles placed around an upper edge of the base of the toilet bowl.

4. The device according to claim 2, wherein the electromotor pump has an electromotor pump inlet and an electromotor pump outlet, the electric resistance heater has an electric resistance heater inlet and an electric resistance heater outlet, the water inlet to the flush box is connected to the electromotor pump inlet, the electromotor pump outlet is connected to a conduit which is connected to the electric resistance heater inlet, the electric resistance heater outlet is connected to the water discharge pipe which is connected to the toilet bowl.

5. The device according to claim 2, wherein the electromotor pump has an electromotor pump inlet and an electromotor pump outlet, the electric resistance heater has an electric resistance heater inlet and an electric resistance heater outlet, the water inlet to the flush box is connected to the electric resistance heater inlet, the electric resistance heater outlet is connected to a conduit which is connected to the electromotor pump inlet, the electromotor pump outlet is connected to the water discharge pipe which is connected to the toilet bowl.

6. The device according to claim 2; wherein the toilet bowl has a seat attached to a base, the seat of the toilet bowl is provided with nozzles for discharging the flush into the toilet bowl and the water discharge pipe is connected to the seat of the toilet bowl and in fluid communication with the nozzles.

7. The device of claim 2, wherein the discharge pipe communicates with spray holes which are located within the toilet bowl.

8. The device of claim 7, wherein the discharge pipe ends in spray nozzles which are located within the toilet bowl so as to direct the flush of the cleansing fluid to inner walls of the toilet bowl.

9. The device according to claim 8, wherein the toilet bowl has an inner wall surface and the nozzles are located within the toilet bowl to direct the flush tangentially to the inner wall surface of the toilet bowl in order to avoid dispersions.

10. A device for flushing, cleaning and servicing a toilet bowl, comprising, an electrically operated water flush box, the flush box having an inlet for being connected to a water inlet pipe of a domestic water system and an outlet for connecting to a discharge pipe for being connected to the toilet bowl, the flush box comprising an electromotor pump for regulating the outlet pressure of water to be discharged from the flush box, electrical resistance heaters for heating the water in the flush box, an inner tank for containing at least one cleaning and deodorizing substance located within the flush box and means for admixing cleaning and deodorizing substances from the inner tank to the water in the flush box only when the water in the flush box is under pressure, thereby heating and supplying under control for an adjustable time a flush of water, mixed with at least one substance selected from the group consisting of substances for deterging, disinfecting, and removing calcareous deposits from the toilet bowl to which the fluid is conveyed by the discharge pipe, comprising a push button for controlling the flow rate of the cleansing fluid to be varied according to the amount necessary to clean the toilet bowl.

11. The device of claim 10, wherein the fluid is supplied in an amount controlled to be varied according to the amount necessary to clean the toilet bowl by having the user push the push button until the degree of cleanliness desired by the user is reached.

12. The device of claim 10, wherein the fluid is supplied to the toilet bowl at a number of different pressures according to the time the push button is pressed by the user.

13. A method for flushing, cleaning and servicing a toilet bowl, comprising the steps of:

passing water from a domestic system water inlet pipe into an electrically operated water flush box, pumping the water in the flush box in an electromotor pump to regulate the water outlet pressure of the water in the flush box, admixing at least one cleaning and deodorizing substance, selected from the group consisting of substances for deterging, disinfecting and removing calcareous deposits, from an inner tank in the flush box to the water in the flush box only when the water in the flush box is under pressure, and supplying under control, for an adjustable time a flush of pressurized fluid comprising the at least one substance admixed with the water from the flush box through a discharge pipe to the toilet bowl, wherein the water flush box is provided with a control panel including: a door for supplying the substances to be added to the fluid; a thermostat for regulating the temperature of the fluid; a pilot light; an operation push button; and the flush is initiated to discharge the fluid from the flush box and convey the discharged fluid to the toilet bowl, by a user pressing the push button.

14. The method of claim 13, further comprising heating the water in the flush box with electrical resistances before the water has been pressurized.

15. The method according to claim 13, wherein the flush fluid conveyed to the toilet bowl by the discharge pipe is an emulsion of the at least one substance and water, and passes through spray nozzles which are located within the toilet bowl, directing the flush fluid, from the spray nozzles, tangentially to the wall surface of the sanitary fixture or toilet bowl without dispersions away from the wall surface.

16. The method according to claim 13, wherein the toilet bowl has a base and a seat, the base is provided with an upper inner edge, and the spray nozzles are placed around the upper inner edge.

17. The method according to claim 13, wherein the toilet bowl has a base and a seat, the base is provided with an upper inner edge, and the spray nozzles are placed around the seat.

18. The method of claim 13, further comprising heating the water in the flush box with electrical resistances after the water has been pressurized.

19. The method of claim 13, wherein a user presses a push button for controlling the flow rate of the cleansing fluid according to the amount necessary to clean the sanitary fixture.

20. The method of claim 19, wherein the fluid is supplied in an amount controlled to be varied according to the amount necessary to clean the toilet bowl by having the user push the push button until the degree of cleanliness desired by the user is reached.

21. The method of claim 20, wherein the fluid is supplied to the toilet bowl at a number of different pressures according to the time the push button is pressed by the user.

* * * * *